United States Patent [19]

Sailer

[11] Patent Number: 4,979,484

[45] Date of Patent: Dec. 25, 1990

[54] DEVICE FOR CONTROLLING AT LEAST ONE THROTTLE CROSS-SECTION AT LEAST ONE CONTROL ORIFICE

[75] Inventor: Harald Sailer, Markgröningen, Fed. Rep. of Germany

[73] Assignee: Robert Bosch GmbH, Stuttgart, Fed. Rep. of Germany

[21] Appl. No.: 445,855

[22] PCT Filed: Apr. 20, 1988

[86] PCT No.: PCT/DE88/00237

§ 371 Date: Oct. 20, 1989

§ 102(e) Date: Oct. 20, 1989

[87] PCT Pub. No.: WO88/09434

PCT Pub. Date: Dec. 1, 1988

[30] Foreign Application Priority Data

May 19, 1987 [DE] Fed. Rep. of Germany ..... 3716663
Jan. 16, 1988 [DE] Fed. Rep. of Germany ..... 3801084

[51] Int. Cl.[5] ..... F02M 3/07
[52] U.S. Cl. ..... 123/585
[58] Field of Search ..... 123/585, 586, 587, 339

[56] References Cited

U.S. PATENT DOCUMENTS 4,426,988 1/1984 Greiner et al. ..... 123/585
4,428,356 1/1984 Kemmer ..... 123/585
4,483,309 11/1984 Norman et al. ..... 123/586
4,494,517 1/1985 Kratt et al. ..... 123/585

*Primary Examiner*—Andrew M. Dolinar
*Assistant Examiner*—M. Macy
*Attorney, Agent, or Firm*—Michael J. Striker

[57] ABSTRACT

The device for controlling at least one throttle cross-section at least one control orifice in a bypass line, through which operating medium is fed, regulates the idling speed of an internal combustion engine having an electric positioning motor by which, upon excitation, a throttle member is operable against a spring element so that it opens at least one control orifice to a greater or lesser extent. When the positioning motor is not excited, the throttle member is movable by the spring element into a position in which it opens an emergency-running cross-section of a control orifice. When the spring element is inoperative and the positioning motor is excited, the throttle member is movable into a position which opens a safety cross section of the control orifice. Advantageously, the throttle member is provided with a triangular throttle orifice and the single control orifice is parallelogram shaped. Alternatively, two control orifices may be provided which overlap two throttle orifices in the throttle member to a greater or lesser extent in various relative orientations of the throttle member.

12 Claims, 5 Drawing Sheets

FIG. 4a
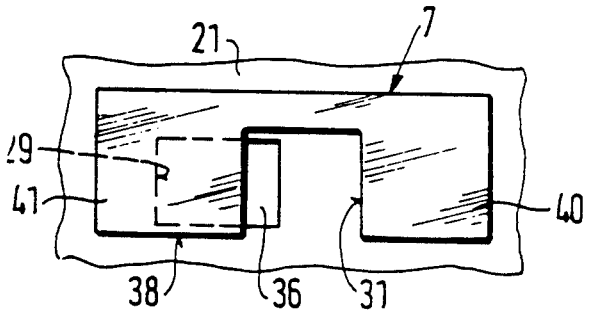
FIG. 4b
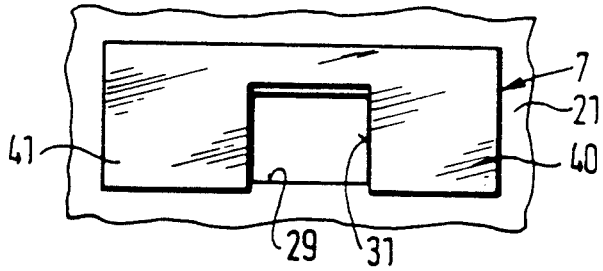
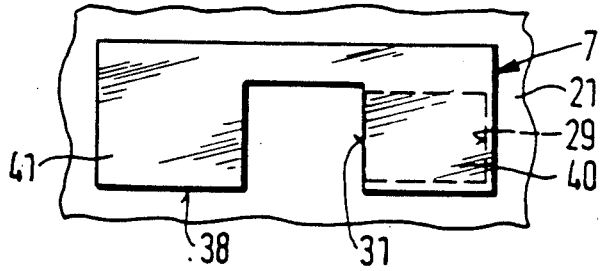
FIG. 4c
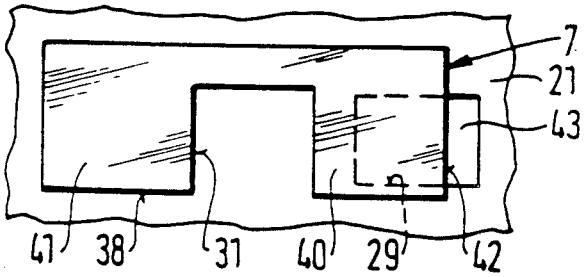
FIG. 4d

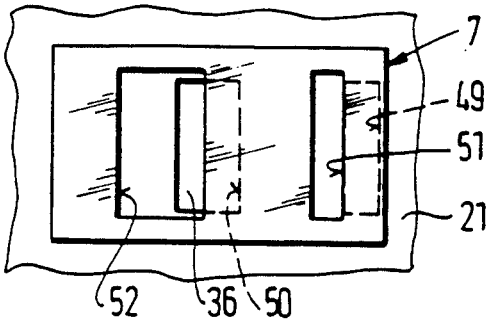
FIG. 7a
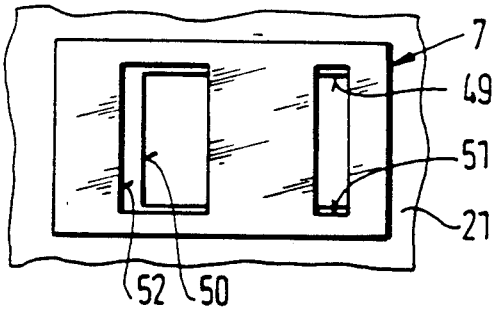
FIG. 7b
FIG. 7c
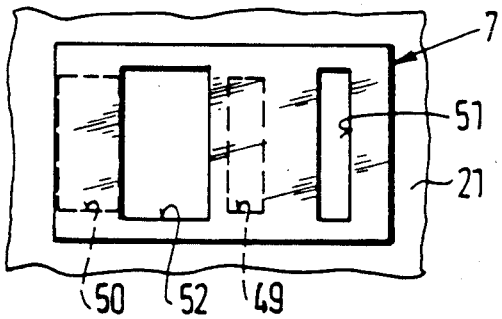
FIG. 7d
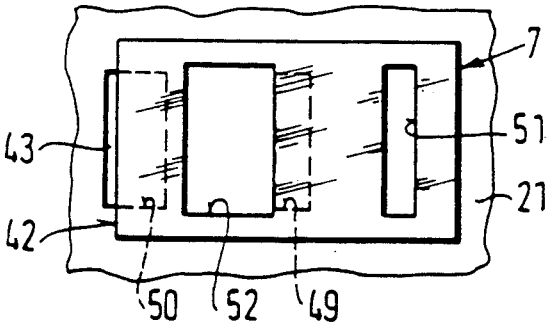

DEVICE FOR CONTROLLING AT LEAST ONE THROTTLE CROSS-SECTION AT LEAST ONE CONTROL ORIFICE

BACKGROUND OF THE INVENTION

The invention is based on a device of the generic type of the main claim. A device of this kind is already known (German Offenlegungsschrift No. 3,234,468), but in this there is the disadvantage that the complete opening of the control orifice, starting from a control orifice opening forming an emergency-running cross-section, is attainable only after traversal of the maximum control path of the throttle member, for which the maximum control current is required to excite the positioning motor. A device of this kind is used to regulate the idling speed of internal combustion engines in order, with the minimum possible speed, to achieve favorable consumption figures and emission values. Here, the lowest possible idling speed is dependent on various operating conditions of the internal combustion engine, for example on the load condition, the external temperature and the engine temperature or the power requirement of systems which are driven by the internal combustion engine, for example an air conditioning system. By virtue of this and in particular at very low starting temperatures of the internal combustion engine, the supply voltage delivered by the battery of the motor vehicle falls and the positioning motor of the idle-regulation device cannot be supplied with the necessary current to adjust the throttle member, precisely in this operating condition, to a position which opens the control orifice completely.

In addition, in the known device there is the danger that if the spring element breaks and the positioning motor is excited, the control orifice will be opened completely by the throttle member and the operation of the internal combustion engine will be influenced in an undesirable manner or even endangered.

SUMMARY OF THE INVENTION

It is an object of the present invention to provide a device for controlling at least one throttle cross-section of a throttle member operable against a spring element at at least one control orifice so that the engine operation will not be undesirably influenced or endangered, if the positioning motor is excited and the spring element broken.

It is also an object of the present invention to provide a device for controlling at least one throttle cross-section of a throttle member operable against a spring element at at least one control orifice so that engine idle is properly regulated despite a fall in battery current, especially at low temperatures.

Accordingly, these objects and others are attained in a device for controlling at least one throttle cross section of the above-described kind which is designed and structured so that a throttle member having at least one throttle orifice can be positioned relative to at least one control orifice in a bypass line of the internal combustion engine carrying an operating medium, so that a safety cross-section is opened in the bypass line, when the spring element is inoperative and the positioning motor is excited.

With a device for controlling the throttle cross section of this kind the internal combustion engine continues to run safely, but also, for example, avoids a situation in which the internal combustion engine reaches undesirably high speeds, when the spring element is broken, but the positioning member is excited.

Advantageous further developments and improvements of the device given in the main claim are possible by virtue of the measures listed in the subclaims.

It is particularly advantageous, if necessary, to move the throttle member beyond the position in which it closes the control orifice into the position which opens the safety cross-section.

It is furthermore advantageous to provide the throttle member with at least one throttle orifice which, when the throttle member is moved, starting from a position which opens the emergency-running cross-section, opens at least one control orifice to a greater or a lesser extent, it being possible for the control orifices and throttle orifices to have a rectangular or quadratic cross-section and for the safety cross-section of the control orifice to be opened by a control edge of the throttle member.

It is likewise advantageous to provide the bypass line with a left-hand and a right-hand control orifice and to provide the throttle member with a left-hand and a right-hand throttle orifice, the emergency-running cross-section being formed by an at least partial overlap of the left-hand control orifice and the left-hand throttle orifice.

It is likewise advantageous to shape the control orifice of the bypass line like a parallelogram and to shape the throttle orifice of the throttle member like a triangle and to arrange them in such a way with respect to one another that two flanks of the throttle orifice, said flanks enclosing an acute angle run approximately parallel to two of the sides of the control orifice and, in a position in which the control orifice is completely open, the two flanks of the throttle orifice and two adjacent sides of the control orifice come into coincidence. In this arrangement, the flanks of the throttle orifice and the sides of the control orifice can merge into one another with a radius, thereby making easier and more exact manufacture possible.

BRIEF DESCRIPTION OF THE DRAWING FIGURES

Exemplary embodiments of the invention are illustrated in simplified manner in the drawing and explained in greater detail in the description below.

FIG. 1 is a graphical illustration which shows the quantity of operating medium flowing through per unit time $\dot{Q}$ versus the adjustment path s of the throttle member, FIG. 2 is a cross-sectional view along the line II—II in FIG. 3 through a device for controlling at least one throttle cross-section, FIG. 3 is a cross-sectional view along the line III—III in FIG. 2, FIGS. 4*a* to *d* are schematic plan views of various positions of a throttle member having a throttle orifice with respect to a control orifice in a first embodiment, FIGS. 5*a* to *d* show a simplified representation of the positions of a throttle member having a triangular throttle orifice with respect to a parallelogram-shaped control orifice in a second embodiment, FIG. 6 shows a plan view of a device embodied in accordance with FIGS. 2 and 3 and having a control orifice and a throttle orifice in accordance with FIGS. 5*a* to *d*, and FIGS. 7*a* to *d* are schematic plan views of the positions of a throttle member designed with two throttle orifices with respect to two control orifices in a third exemplary embodiment.

DETAILED DESCRIPTION OF THE INVENTION

Figure 1:
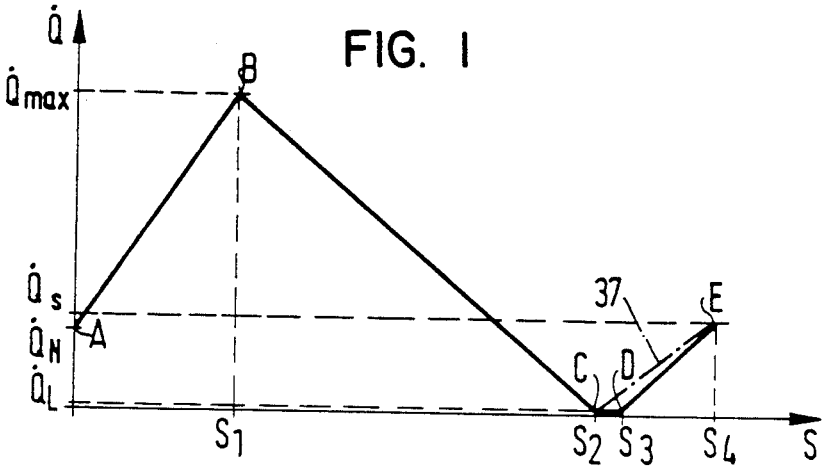

In FIG. 1, the quantity $\dot{Q}$ flowing per unit time, of an operating medium to be controlled, for example of the quantity of idling air for the internal combustion engine, which air is to be controlled during the idling of an internal combustion engine, is plotted against the adjustment path s of a throttle member of a device as described in the following text with reference to various exemplary embodiments. In the device represented in FIGS. 2 and 3, combustion air flows through an intake pipe 2 past a throttle valve 3 in the direction of arrow 1 to an internal combustion engine (not shown). The intake pipe 2 is connected to a bypass line 5 which leads round the throttle valve 3 and the passage cross-section of which can be altered by the device 6 by means of a throttle member 7. The device 6 is controlled by an electronic control device 8 to which are applied at 10 the supply voltage delivered by the vehicle battery, at 11 the signal for the speed of the internal combustion engine, said signal being taken from the distributor of the internal combustion engine, at 12 the signal for the engine temperature and at 13 a voltage which identifies the position of the throttle valve 3 and is supplied, for example, by a potentiometer connected to the throttle valve 3. If required, additional operating variables of the internal combustion engine can be fed into the electronic control device 8.

In the present exemplary embodiment, an electric motor 15 (not illustrated in greater detail) which can be controlled by the electronic control device 8 via a plug connector 16, as a function of operating variables of the internal combustion engine, is used as positioning motor of the device 6. In the excited condition, the electric motor 15 rotates a hollow shaft 17 which, via roller bearings 18, is rotatably mounted about a spindle 19 which is pressed into a housing base 21 of a pot-shaped housing 22 of the device 6 and is fixed therein. The throttle member 7, which is of tube segment-shaped design and extends into a pivoting space 24 which is formed in the housing base 21 and divides the bypass line 5, is connected nonrotatably to the hollow shaft 17. An inflow connection 26 to the intake pipe 2 upstream of the throttle valve is connected to the pivoting space 24 on the one hand and an outflow connection 27 to the intake pipe 2 downstream of the throttle valve 3 is connected to the pivoting space 24 on the other hand. The periphery of the tube segment-shaped throttle member 7 extends in as leak-proof manner as possible as far as the wall of the pivoting space 24. At least one control orifice 29 which can be opened to a greater or a lesser extent by the throttle member 7 is cut into that wall 28 of the pivoting space 24 which faces the inflow connection 26. For this purpose, it is possible, for example, for the tube segment-shaped throttle member 7 to have a throttle orifice 31 which penetrates it and, in the case of a rotary movement of the throttle member 7, is brought to a greater or a lesser extent into overlap with the control orifice 29 and thereby opens the control orifice 29 to a greater or lesser extent, with the formation of a throttle cross-section. The rotation of the throttle member 7 by the electric motor 15 takes place against the force of a spring element which may, for example, be designed as a flat coil spring 32 and is connected by its inner end to the hollow shaft 17 and by its outer end to the housing 22. In the the non-excited condition of the electric motor 15, the flat coil spring 32 rotates the hollow shaft 17 by a stop portion 33 against a stop screw 34 screwed into the housing base 21. With the stop portion 33 resting against the stop screw 34, the throttle member 7 is held by the flat coil spring 32 in a starting position in which the control orifice 29 is not completely closed by the throttle member 7 but in which the throttle orifice 31 is in partial overlap with the control orifice 29, with the result that in this position, an emergency-running cross-section 36 remains open, via which air or a mixture can flow through the bypass line 5 into the intake pipe 2 from upstream of the throttle valve to downstream of the throttle valve 3. In the event of the failure of the supply of current to the device 6, the quantity of operating medium flowing through the emergency-running cross-section 36 per unit time is sufficient to provide a favorable fuel/air mixture for the continued running of the internal combustion engine or to allow a predetermined favorable quantity to flow to the engine on starting the internal combustion engine. In the graphical illustration according to FIG. 1, the quantity of operating medium flowing through the emergency-running cross-section per unit time is designated by $\dot{Q}_N$, given the presence of which the throttle member 7 is in its starting position zero.

The intention is now, according to the invention, starting from the starting position zero of the throttle member, said position representing the emergency-running cross-section 36, that, when the electric motor is excited, the throttle member 7 should execute a movement in a direction of movement which remains the same, during which it first of all opens the control orifice 29 completely by means of the throttle orifice 31 and should only then be moved further by the electronic control device in accordance with the control current depending on the operating variables of the internal combustion engine so that it closes the control orifice 29 to a greater or lesser extent, and so that the overlap between the throttle orifice 31 and the control orifice 29 is reduced. This produces a characteristic curve for the device 6 as shown in FIG. 1. In the throttle member starting position representing the control path zero, the curve illustrated in FIG. 1 begins at point A with a quantity of emergency-running operating medium per unit time $\dot{Q}_N$ through the emergency-running cross-section 36. If the electric motor 15 is excited by the control device 8, the electric motor 15 moves the throttle member 7 in the direction of a further enlargement of the throttle cross-section formed between the control orifice 39 and the throttle orifice 31, until after the relatively short adjustment path $s_1$, the control orifice 29 and the throttle orifice 31 overlap completely and, at point B of the curve, maximum quantity of operating medium per unit time $\dot{Q}_{max}$ can flow via the bypass line 5. Only after the position of the throttle member which is identified by point B and in which the maximum quantity $\dot{Q}_{max}$ of operating medium can flow via the control orifice 29, is it possible, by virtue of a movement of the throttle member 7 continued in the same direction of movement as previously, for a reduction of the overlap between the control orifice 29 and the throttle orifice 31 to take place in accordance with the control signals of the control device 8 so that, if required, the throttle cross-section formed between these two orifices can be reduced, or is closed so that there is no longer any overlap between the control orifice 29 and the throttle orifice 31 and only a leakage quantity attributable to leaks flows via the bypass line 5. The movement of the throttle member 7 from position $s_1$, in which the control orifice 29 is completely opened by the throttle orifice 31, into position $s_2$, in which the control orifice 29 is completely closed by the throttle member 7 and only a leakage quantity per unit time $\dot{Q}_L$ can still flow via the bypass line 5, and which is identified by point C, is characterized by the curve shape between points B and C. In a further embodiment of the device, provision can be made in the event of a failure, for example breakage of the flat coil spring 32, for the throttle member 7 to be moved by the excited electric motor 15 into a position $s_4$ in which the throttle member 7 opens a safety cross-section at the control orifice 29, allowing a quantity of operating medium per unit time $\dot{Q}_S$ to flow via this safety cross-section and via the bypass line 5, which quantity guarantees safe operation of the internal combustion engine which does not endanger the internal combustion engine and which quantity is less than the maximum possible quantity of operating medium flowing per unit time $\dot{Q}_{max}$ via the control orifice 29.

It is possible for point E in FIG. 1, identifying the safety cross-section, to be reached directly from position $s_2$ of the throttle member 7 at point C, in which only a leakage quantity $\dot{Q}_L$ flows in accordance with the chain-dotted line 37 by a movement into position $s_4$ during which, starting from the leakage quantity $\dot{Q}_L$ at point C, a renewed enlargement of the throttle cross-section at the control orifice 29 takes place up to point E. A further possibility comprises first of all moving the throttle member 7 from position $s_2$ as far as position $s_3$ without the control orifice 29 being opened. The adjustment movement from position $s_2$ to position $s_3$ of the throttle member 7 is identified as the curve from point C to point D. In the adjustment range between position $s_2$ and position $s_3$ only the leakage quantity $\dot{Q}_L$ can flow via the control orifice 29. The further opening of the throttle cross-section up to point E, in which the throttle member 7 occupies position $s_4$ and the safety cross-section at the control orifice 29 is open, via which cross-section the safety quantity of operating medium $\dot{Q}_s$ can flow, takes place in accordance with the solid line, starting from point D, that is to say position $s_3$ of the throttle member 7. In the case of an adjustment of the throttle member 7 in the same direction of movement, the characteristic curve which is illustrated in FIG. 1 and extends between points A, B, C, D and E indicates the size of the throttle cross-section formed between the at least one control orifice 29 and the at least one throttle orifice 31, said size being equivalent to the quantity of operating medium flowing via the bypass line 5 per unit time Q. In this arrangement, it is particularly advantageous that, upon excitation of the electric motor 15, the complete opening of the control orifice 29 by the throttle orifice 31 can already be achieved in position $s_1$ after a very short adjustment path, starting from the starting position of the throttle member 7, said starting position representing the emergency-running cross-section 36, in which position the maximum quantity of operating medium $\dot{Q}_{max}$ can flow via the bypass line 5. Only in the event of a further movement of the throttle member 7 beyond position $s_1$ does the actual regulation of the throttle cross-section up to point C begin so that each intermediate position of the throttle member 7 from the complete opening of the control orifice 29 at point B and the maximum quantity of operating medium $\dot{Q}_{max}$ flowing which is possible in this position to virtually complete blocking of the control orifice 29 at point C, in which only a leakage quantity $\dot{Q}_L$ can flow, is possible as a function of the operating variables of the internal combustion engine. The variable curve shape shown ensures that, even in the most unfavourable starting conditions of the internal combustion engine, in which, as a result of low starting temperatures and a requirement for current also for other units of the internal combustion engine, the supply voltage of the motor vehicle battery has fallen, this low supply voltage is still sufficient to move the throttle member 7 into a position $s_1$ in which a maximum quantity of operating medium $\dot{Q}_{max}$ usually required for the reliable start and continued running of the internal combustion engine can flow via the bypass line 5.

Figure 2:
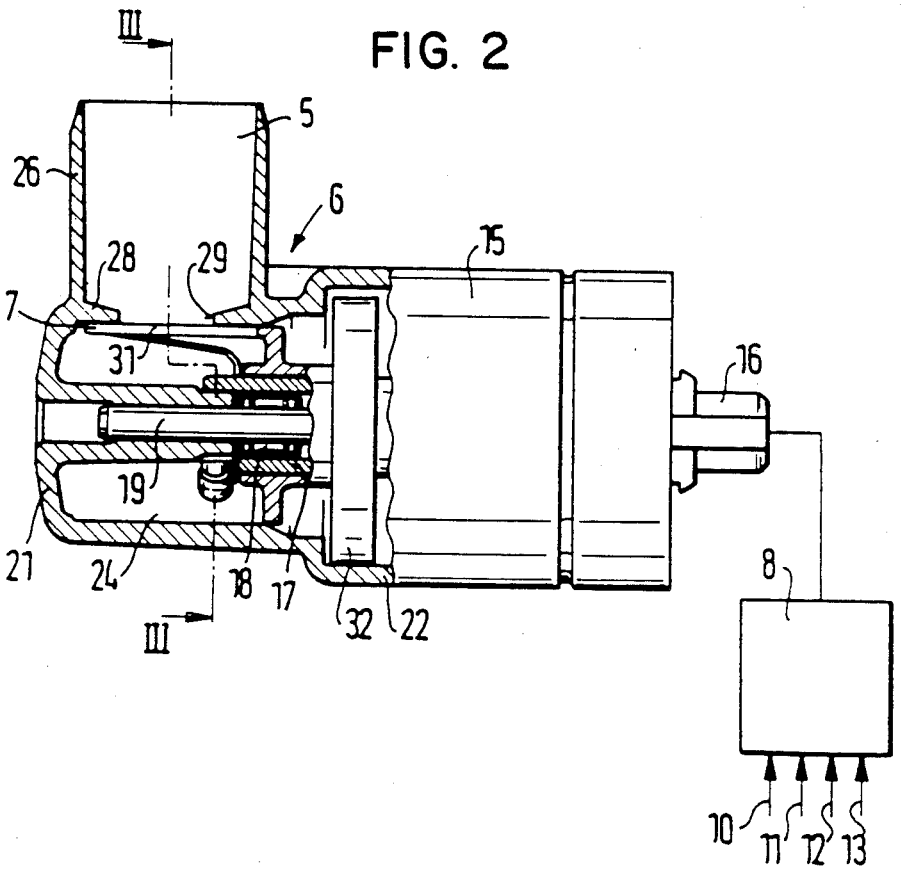
Figure 3:
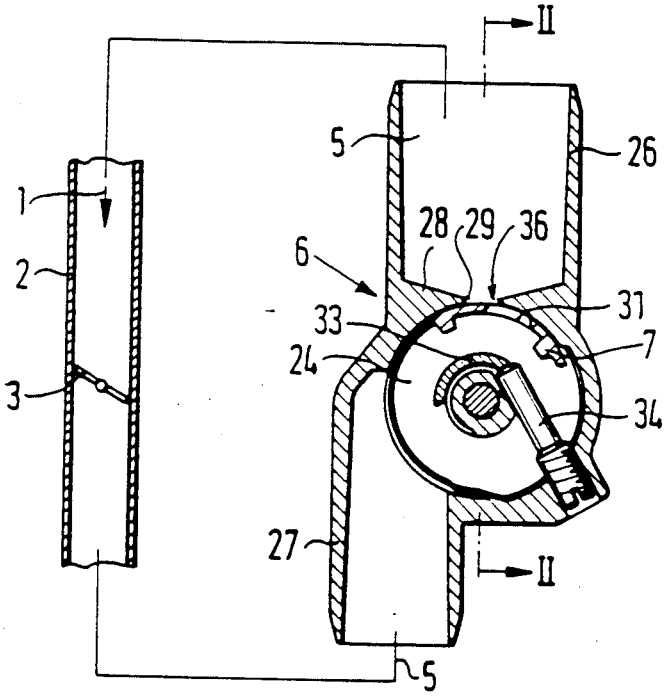

An exemplary embodiment of throttle member 7 and of control orifice 29 of device 6 according to FIGS. 2 and 3, by means of which exemplary embodiment a characteristic curve according to the curve shape from A to E according to FIG. 1 can be achieved, is illustrated in FIGS. 4*a* to *d*. The same reference numerals have been chosen for parts which are the same and have the same effect. The embodiment according to FIGS. 4*a* to *d* can be used not only with an embodiment of the throttle member as a rotary slide but also with other embodiments of the throttle member 7, for example in the form of a planar flat slide. In FIG. 4 the throttle member 7 is designed, for example, as a planar flat slide and has a rectangular throttle orifice 31, which may also be quadratic, circular or of some other spherical shape. The throttle orifice 31 is open at the edge 38 of the throttle member 7, but can also be closed. In the direction of movement, the throttle orifice 31 is bounded by a right-hand wing 40 and on the other side by a left-hand wing 41. In FIG. 4*a*, the throttle member 7 occupies its starting position which corresponds to point A of the curve in FIG. 1 and in which the control orifice 29 and the throttle orifice 31 overlap only partially, with the result that the emergency-running cross-section 36 at the control orifice 29 remains open while the left-hand wing 41 partially blocks the control orifice 29. In the exemplary embodiment, the control orifice 29 is illustrated in rectangular form but may likewise be quadratic, circular or of some other spherical shape. When the electric motor 15 is excited, the throttle member 7 is moved to the left with respect to the control orifice 29, in accordance with FIG. 4*b*, and in the process comes into a position $s_1$ in accordance with FIG. 1 in which the control orifice 29 and the throttle orifice 31 overlap completely and the control orifice 29 is completely open, allowing the maximum quantity of operating medium $\dot{Q}_{max}$ to flow. The actual regulation of the throttle cross-section according to the curve shape from B to C in FIG. 1 begins from the position illustrated in FIG. 4*b*. The control orifice 29 and the throttle orifice 31 overlap to a greater or lesser extent or, respectively, the right-hand wing 40 closes the control orifice 29 to a greater or lesser extent. The position illustrated in FIG. 4*c* corresponds to position $s_2$ in FIG. 1, in which the control orifice 29 is completely closed by the right-hand wing 40 and only a leakage quantity $\dot{Q}_L$ can still flow. If the flat coil spring 32 fails and the electric motor 15 is in the excited condition, the throttle member 7 can now be moved further to the left in accordance with FIG. 4*d* in order, in position $s_4$ corresponding to point E in FIG. 1, to open the control orifice 29 again somewhat by means of a control edge 42, formed on the right-hand wing 40, to form a safety cross-section 43.

Figure 5A:
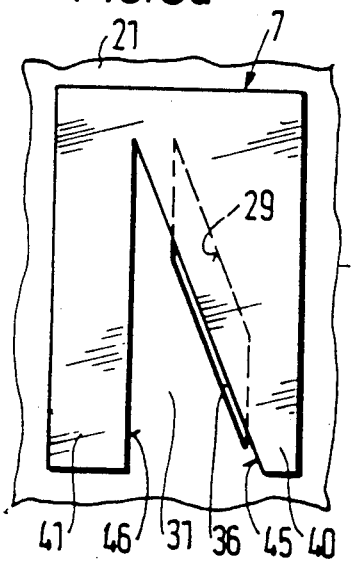
Figure 5B:
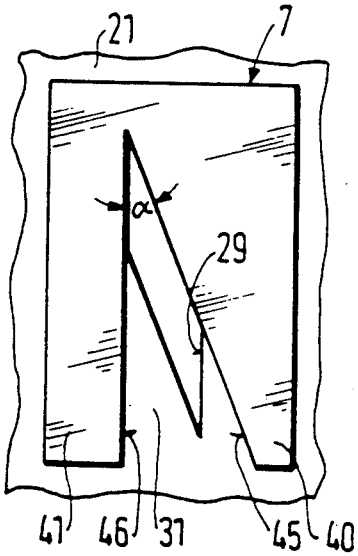
Figure 5C:
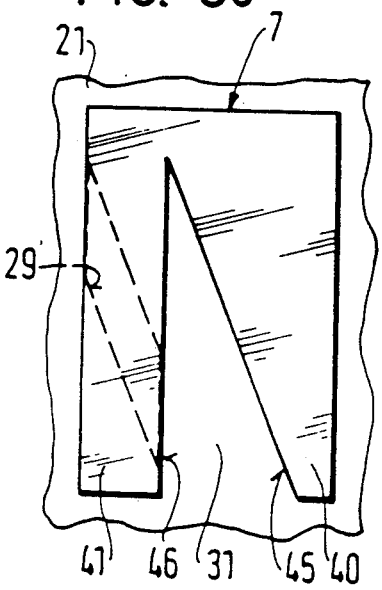
Figure 5D:
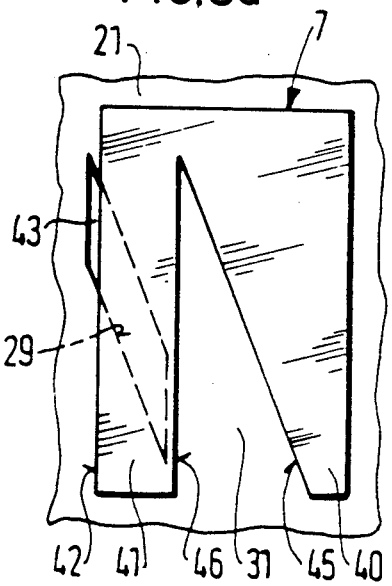

A further exemplary embodiment of the device 6 according to FIGS. 2 and 3 to produce a characteristic curve in accordance with FIG. 1 is shown in FIGS. 5*a* to *d*, in which the reference numerals used already are employed for parts which are the same and have the same effect. In the exemplary embodiment according to FIGS. 5*a* to *d*, the control orifice 29 of the device 6 has the shape of a parallelogram and the throttle orifice 31 formed in the throttle member 7 has the shape of a triangle which, for example, as illustrated, is open towards one edge of the throttle member but may also be closed. The throttle member 7 may once again likewise be planar, accurate or of some other shape. The right-hand wing 40 is bounded by a left-hand flank 45 of the triangular throttle orifice 31 and the left-hand wing 41 is bounded by a right-hand flank 46 of the throttle orifice 31 and the left-hand flank 45 and the right-hand flank 46 enclose between them an acute angle $\alpha$ which corresponds to the acute angle of the parallelogram-shaped control orifice 29 between two adjacent sides of the control orifice. The throttle member 7 and the control orifice 29 are arranged in such a manner with respect to one another that the left-hand flank 45 and the right-hand flank 46 in each case run parallel to two of the sides of the control orifice 29 and that, when the throttle member 7 is moved into a position in which the control orifice 29 is completely open, the flanks 45, 46 of the throttle orifice 31, which flanks enclose the angle $\alpha$, come into coincidence with two adjacent sides, which likewise enclose an angle $\alpha$. In the position of the throttle member 7 illustrated in FIG. 5*a*, the starting position is shown in which the control orifice 29 and the throttle orifice 31 partially overlap to form the emergency-running cross-section 36, that is to say the right-hand wing 40 covers the control orifice 29 only partially with the left-hand flank 45. FIG. 5*b* illustrates the position $s_1$ of the throttle member 7 in accordance with FIG. 1, in which the throttle orifice 31 opens the control orifice 29 completely to allow through a maximum quantity of operating medium $\dot{Q}_{max}$ and the flanks 45, 46 coincide with two adjacent sides of the parallelogram-shaped control orifice 29. FIG. 5*c* shows the position $s_2$ according to FIG. 1 of the throttle member 7, in which the left-hand wing 41 blocks the control orifice 29 completely and only a leakage quantity $\dot{Q}_L$ can flow. To control a safety cross-section 43 at the control orifice 19, the throttle member 7 can be moved further towards the right into a position $s_4$ in accordance with FIG. 1, in which part of the control orifice 29 is opened again by the control edge 42 of the left-hand wing 41.

Figure 6:
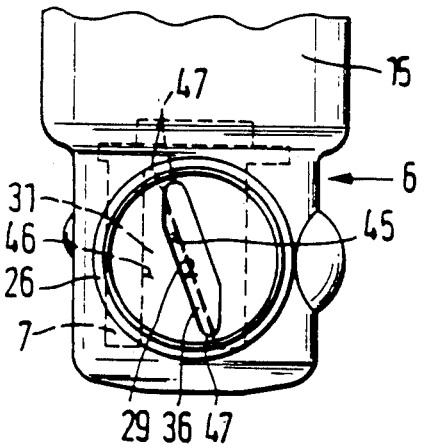

FIG. 6 shows a plan view of a device 6 according to FIGS. 2 and 3, with a view into the inflow connection 26, through which the control orifice 29, which can be controlled by a throttle member 7 indicated by broken lines, can be seen. The control orifice 29 is, in accordance with the exemplary embodiment according to FIG. 5*a* to *d*, of parallelogram-shaped design and the throttle orifice 31 in the throttle member 7 is of triangular design. In the illustration according to FIG. 6, the flanks 45, 46 of the throttle orifice 31 and the sides of the control orifice 29 merge into one another with a radius 47, thereby making it possible to produce these orifices more easily and more accurately.

In the additional exemplary embodiment illustrated in FIG. 7, parts which are the same and have the same effect are identified by the same reference numerals as hitherto. In the exemplary embodiment according to FIGS. 7*a* to *d*, in contrast to the exemplary embodiment according to FIGS. 4*a* to *d*, two control orifices 49, 50 and two throttle orifices 51, 52 in the throttle member 7 are provided. These orifices are illustrated with a rectangular cross-section but may have another shape in the manner described above. The control orifices 49, 50 and the throttle orifices 51, 52 are in each case arranged at a distance from one another. The control orifices 49, 50 are expediently of different widths, and the same applies to the throttle orifices 51, 52. In the embodiment illustrated in FIGS. 7*a* to *d*, the control orifice 49 arranged on the right is narrower than the control orifice 50 arranged on the left and the throttle orifice 51 arranged on the right is narrower than the throttle orifice 52 arranged on the left. In the manner illustrated, the distance between the orifices can be selected such that, in the starting position of the throttle member 7, that is to say when the electric motor 15 is not excited, the right-hand control orifice 49 is closed by the throttle member 7 and the left-hand control orifice 50 is in partial overlap with the left-hand throttle orifice 52 so as to form the emergency-running cross-section 36, as shown in FIG. 7*a*. In the position $s_1$ of the throttle member 7 according to FIG. 1, which position is illustrated in FIG. 7*b*, the two control orifices 49, 50 are completely opened by the control orifices 51 52, allowing the maximum quantity of operating medium $\dot{Q}_{max}$ to flow via the bypass line 5. If the throttle member 7, which is likewise designed as a flat slide, rotary slide or is of some other shape, is moved further, the throttle member 7 comes to occupy a position $s_2$ which is illustrated in FIG. 7*c* and in which the control orifices 49, 50 are closed and, in accordance with FIG. 1, only a leakage quantity $\dot{Q}_L$ still flows. If the flat coil spring 32 fails and the electric motor 15 is excited, the throttle member 7 occupies a position $s_4$ according to FIG. 1, as shown in FIG. 7*d*, in which the control edge 42 partially opens the left-hand control orifice 50 to form a safety cross-section 43. In the exemplary embodiment illustrated, the right-hand control orifice 49 is not made use of for the formation of the safety cross-section, but the embodiment could also be chosen such that a part of the control orifice 50 and a part of the control orifice 49 could be opened to form the safety cross-section in a manner not shown.

It will be understood that each of the elements described above, or two or more together, may also find a useful application in other types of structures differing from the types described above.

While the invention has been illustrated and described as embodied in a device for controlling at least one throttle cross-section at at least one control orifice, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims:

1. In a device for controlling at least one throttle cross-section at at least one control orifice in a bypass line of an internal combustion engine, said bypass line having an associated throttle member and carrying operating medium, for regulating an idling speed of said internal combustion engine having an electric positioning motor by which, upon excitation, said throttle member being operable against a force of a spring element so that it opens at least one control orifice to a variable extent, while, when the positioning motor is not excited, the throttle member is movable by the spring element into a position in which it opens an emergency-running cross-section of the at least one control orifice, the improvement wherein, when the spring element is inoperative and the positioning motor is excited, the throttle member is movable into a position which opens a safety cross section of the control orifice.

2. A device according to claim 1, wherein the throttle member is movable beyond a position in which it closes the control orifice into said position which opens said safety cross section.

3. A device according to claim 1, wherein the throttle member has at least one throttle orifice which, when the throttle member is moved, opens the at least one control orifice to a variable extent.

4. A device according to claim 3, wherein said throttle member has a control edge and the safety cross-section of the control orifice is opened by said control edge of the throttle member.

5. A device according to claim 3, wherein each control orifice and each throttle orifice has a rectangular cross-section.

6. A device according to claim 3, wherein the bypass line is provided with a left-hand control orifice and a right-hand control orifice and the throttle member is provided with a left-hand throttle orifice and a right-hand throttle orifice, and an emergency-running cross-section is formed by an at least partial overlap of the left-hand control orifice of the bypass line and the left-hand throttle orifice of the throttle member.

7. A device according to claim 3, wherein the bypass line is provided with one of said control orifices and the throttle member is provided with one of said throttle orifices and the control orifice of the bypass line is shaped like a parallelogram and the throttle orifice of the throttle member is shaped like a triangle, and said control orifice and said throttle orifice are positioned relative to one another so that two flanks of the throttle orifice, said flanks enclosing an acute angle, each run approximately parallel to one of two sides of the control orifice and, in a position in which the control orifice is completely open, the two flanks of the throttle orifice and two adjacent sides of the control orifice come into coincidence.

8. A device according to claim 7, wherein the flanks of the throttle orifice and the sides of the control orifice merge into one another.

9. A device according to claim 7, wherein, to form an emergency-running cross-section, the parallelogram-shaped control orifice and the triangular throttle orifice are positionable relative to each other to partially overlap.

10. A device according to claim 9, wherein the throttle member has a control edge and the safety cross-section of the control orifice is opened by said control edge.

11. A device according to claim 1, wherein the throttle member is designed as a rotary slide protruding into the bypass line.

12. A device according to claim 3, wherein each control orifice and each throttle orifice is provided with a square cross-section.

* * * * *